US006758135B2

(12) United States Patent
Linnonmaa et al.

(10) Patent No.: US 6,758,135 B2
(45) Date of Patent: Jul. 6, 2004

(54) METHOD AND DEVICE FOR MOISTURIZATION OF A PAPER OR BOARD WEB IN CALENDERING

(75) Inventors: Pekka Linnonmaa, Järvenpää (FI); Antti Heikkinen, Helsinki (FI); Markku Kyytsönen, Numminen (FI); Ville Vuorijärvi, Nummenkylä (FI); Pekka Moisio, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/182,368

(22) PCT Filed: Jan. 26, 2001

(86) PCT No.: PCT/FI01/00072

§ 371 (c)(1),
(2), (4) Date: Oct. 23, 2002

(87) PCT Pub. No.: WO01/55504

PCT Pub. Date: Aug. 2, 2001

(65) Prior Publication Data

US 2003/0089248 A1 May 15, 2003

(30) Foreign Application Priority Data

| | | |
|---|---|---|
| Jan. 28, 2000 | (FI) | 20000187 |
| Sep. 15, 2000 | (FI) | 20002036 |
| Oct. 13, 2000 | (FI) | 20002267 |

(51) Int. Cl.[7] ..... B30B 15/34; B30B 15/30

(52) U.S. Cl. ..... 100/38; 100/75; 100/161; 102/206

(58) Field of Search ..... 100/35, 38, 73, 100/74, 75, 102, 162 R, 161, 331, 303, 332, 333; 162/198, 205, 206, 207, 290, 375

(56) References Cited

U.S. PATENT DOCUMENTS

| | | | | |
|---|---|---|---|---|
| 4,642,164 A | | 2/1987 | Hanhikoski et al. | |
| 5,065,673 A | | 11/1991 | Taylor et al. | |
| 5,445,071 A | * | 8/1995 | Winheim | 100/38 |
| 5,483,873 A | | 1/1996 | Koivukunnas et al. | |
| 5,524,532 A | | 6/1996 | Koivukunnas et al. | |
| 5,914,008 A | | 6/1999 | Winheim | |
| 5,938,895 A | | 8/1999 | Hirvonen | |
| 6,073,549 A | | 6/2000 | Winheim et al. | |

FOREIGN PATENT DOCUMENTS

| | | |
|---|---|---|
| FI | 71966 | 11/1986 |
| FI | 72552 | 2/1987 |
| FI | 95061 | 8/1995 |
| FI | 98230 | 1/1997 |
| GB | 2 150 163 A | 6/1985 |
| WO | WO 00/03087 A1 | 1/2000 |
| WO | WO 01/55504 A1 | 8/2001 |

OTHER PUBLICATIONS

International Preliminary Examination Report issued in PCT/FI01/00072.
International Search Report issued in PCT/FI01/00072.
Search Report issued in Finnish Patent Application No. 20000187.

(List continued on next page.)

*Primary Examiner*—Allen Ostrager
*Assistant Examiner*—Jimmy Nguyen
(74) *Attorney, Agent, or Firm*—Stiennon & Stiennon

(57) ABSTRACT

A paper or board web (W) is calendered in at least one calendering nip (N1–N8), and the web (W) is moisturized before calendering. The web (W) is moisturized by means of liquid moisturization (20; 21) very close before at least one calendering nip (N1, N5). A calender for calendering a paper or board web has at least one liquid moisturizing calendering nip (N1–N8) and at least one device (20; 21) for moisturizing the web (W) is placed very close before at least one calendering nip (N1; N5).

16 Claims, 8 Drawing Sheets

OTHER PUBLICATIONS

Search Report issued in Finnish Patent Application No. 20002036.

Search Report issued in Finnish Patent Application No. 20002267.

"Practical Aspects Concerning Moisture Gradient Calendering" A. Heikkinen, P. Linnonmaa and M. Diebel, Wochenblatt für Papierfabrikation, Jahrgang 127, 1999, Nr. 10, pp. 680–685.

* cited by examiner

PPS-s10: 1.30 um
Density: 1143 kg/m3

PPS-s10: 1.35 um
Density: 1128 kg/m3

| FIBER | SWELLING TIME $t_{75\%}$, ms ± 95% confidence |
|---|---|
| GW | 260 ± 50 |
| PGW | 290 ± 140 |
| TMP | 190 ± 100 |
| FIBER Soft wood pulp | SWELLING TIME $t_{75\%}$, ms ± 95% confidence |
|---|---|
| Summer wood | 320 ± 80 |
| Spring wood | 125 ± 29 |
$t_{75\%}$ Time needed for 75% of total swelling to take place
*Fig.6*
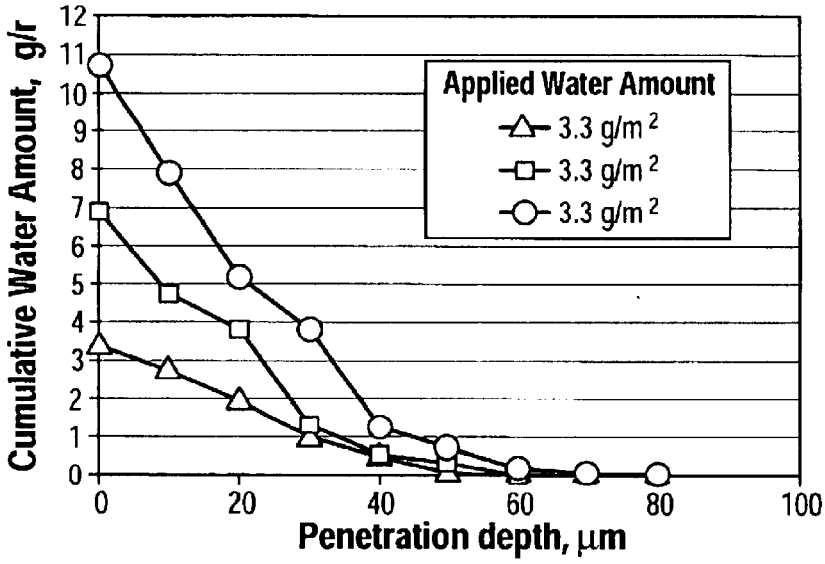
*Fig.7A*
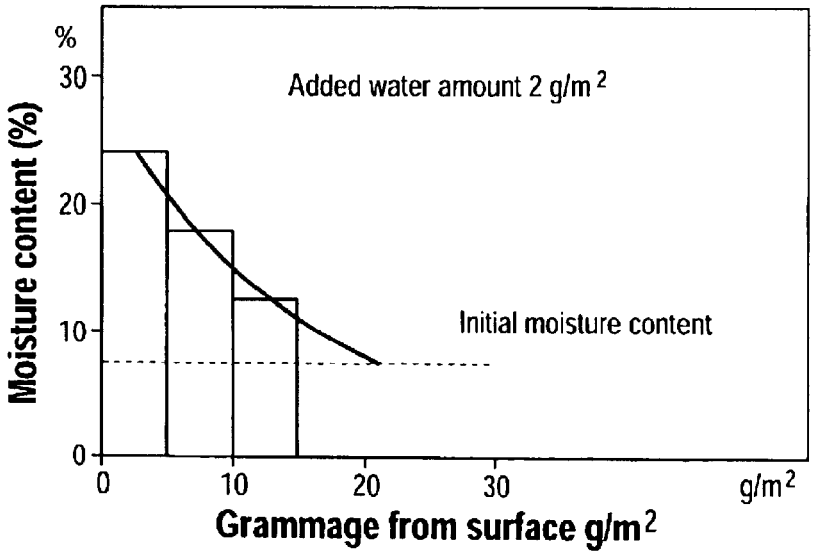
*Fig.7B*

METHOD AND DEVICE FOR MOISTURIZATION OF A PAPER OR BOARD WEB IN CALENDERING

CROSS REFERENCES TO RELATED APPLICATIONS

This application is a U.S. national stage application of International Application No. PCT/FI01/00072, filed Jan. 26, 2001, and claims priority on Finnish Application No. 20000187 filed Jan. 28, 2000; Finnish Application No. 20002036 filed Sep. 15, 2000; and Finnish Application No. 20002267 filed Oct. 13, 2000; the disclosures of these applications being hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

When calendering advantageously in a paper machine it is useful to raise the moisture content of the surface layer of paper so as to be as high as possible and to keep the middle layers of paper optimally dry. By this means, in a nip/nips of a calender or in another contact under pressure there occurs a permanent deformation in the moist surfaces of paper and the dry middle part recovers like an elastic material when the compression load ends. Such a state of the web leads to the fact that the caliper of paper is better preserved when the same surface quality is sought to be achieved (compared with a situation in which moisture is uniformly distributed in paper).

The surface of paper is affected during calendering by external compressing pressure, temperature, and the moisture contained in the web. The smoothening of the paper surface in a calender nip is based on a quick pulse generated by heat and pressure on the surface of paper: the polymers of paper exceed their glass transition temperature because of raised temperature and moisture, and soften so as to be mouldable. By the action of pressure, the surface of a hot and smooth steel roll is copied to the softened and deformable fibres. At the outlet of the nip, the temperature of the fibres falls below the glass transition temperature of polymers, the fibres cool and solidify in their smoothed structure. In addition thereto, the properties of the web are reduced because of compression when the caliper of the web is reduced.

Through calendering, attempts are made to improve the quality values of paper that have already been achieved or, at a standard quality level, to achieve a higher speed or a better bulk of the paper. It is known that the plasticity of paper, i.e. its readiness of being moulded, can be increased by raising the temperature and/or the moisture content of the paper. A considerable change takes place in the plasticity of paper when the temperature of the polymers contained in the paper rises to or beyond the so-called glass transition temperature. Then, the paper can be moulded more readily than below the glass transition temperature. An increase in the moisture content of paper lowers the glass transition temperature. Most commonly, the paper web is heated in a calender nip by means of a heatable roll, a so-called thermo roll and, in addition to this, possibly by means of steam treatment before the calender. The steam treatment also increases the moisture content of the paper, thereby lowering the glass transition temperature and thus enhancing the mouldability of paper.

Thus, when paper is calendered, the effect of calendering on the paper is highly dependent on the moisture content and temperature of the fibres contained in the paper at the time of calendering: the mouldability of the fibres is increased sharply even as if by a jump when their temperature reaches the so-called glass transition temperature, which is directly proportional to the moisture content of the fibres, or when their temperature is above the glass transition temperature. Above the glass transition temperature, it is easy to produce permanent deformations in the fibres, and below said temperature the deformations tend to be reversible. In order to ensure the permanence of the effects of calendering, the web must be moisturized to lower the glass transition temperature and, in addition, very high calendering temperatures and high pressures must be used, in which connection the entire web readily exceeds the glass transition temperature and, thus, the deformation takes place evenly through the entire cross section of the web in the cross direction.

With respect to the prior art relating to the invention, reference is also made to FI Patent 98 230 (corresponding U.S. Pat. No. 5,524,532), which discloses a method and a device of calendering a paper or board web, wherein the web is passed through a calendering nip. The calendering nip is formed of a heated roll and another roll or of a heated roll and an extended-nip roll or of a heated roll and a belt arrangement, by means of which the web is pressed against the heated roll, wherein, before the web enters the calendering nip, a moisture distribution is produced between the surfaces of the web in the thickness direction of the web such that the moisture is higher on that side of the surface of the web which is to be calendered than in the web interior. A temperature difference is produced between the surfaces of the web such that the web surface to be calendered will be on the side of lower temperature, and evaporation of moisture from the web is prevented during the moisture transfer process when the moisture present in the web is transferred towards the surface on the side of the lower temperature.

It is also known from the prior art that by controlling the imbition time water can be caused to stay in the very surface layers of paper. With respect to the prior art relating to this, reference is made to the publication A. Heikkinen, P. Linnonmaa & M. Diebel "*Practical Aspects Concerning Moisture Gradient Calendering*", Wochenblatt für Papierfabrikation, Jahrgang 127, 1999, Nr. 10, pp. 680–685. It is essential that the moisturizing device has a sufficiently small droplet size in order that the small water amounts which are applied shall form a film and not drops here and there on the surface of the paper. The droplet size shall typically be less than 200 $\mu$m, less than 20 $\mu$m on average, advantageously 10 to 20 $\mu$m.

The essential gradient control variables include:

Moisturizing delay

Water temperature

Water quantity

Number of applications

Even though this description mainly refers to paper, it shall be understood that the disclosure also relates to the calendering of board.

One multinip calendering method known in the state of the art is supercalendering, which is calendering in a calender unit in which nips are formed between a smooth-surface press roll, such as a metal roll, and a roll coated with a resilient cover, such as a polymer roll. The resilient-surface roll conforms to the surface contours of paper and presses the opposed side of paper evenly against the smooth-surface press roll. Today the supercalender typically comprises 10 to 12 nips and for the purpose of treating both sides of the web, the supercalender comprises a so-called reversing nip, in which there are two resilient-surface rolls against each other. The linear load increases in the calender from the top nip to the bottom nip because of the force of gravity.

The problems in calendering today are mainly due to the following factors.

a. Initial moisture content, the number of steam treatments and the temperature of calendering are mainly determined by the final moisture content after calendering such that
   i. when the final moisture content becomes too low, the web absorbs moisture, which results in deterioration of the achieved gloss in the form of afterroughening, and
   ii. when the final moisture content becomes too high, the drying of the web effectively destroys the quality values that have been attained.

b. On the other hand, the determination of the initial moisture content of calendering is affected by desired optical properties and the level of blackening. When the final moisture content becomes too high, the opacity, i.e. translucence of the web deteriorates, which appears in a finished paper product as an increase in print-through values, and the blackening level rises, which reduces the selling value of paper in the form of diminished brightness and a poor visual impression.

Because of these factors, the real control variables of a modern calender are relatively limited and the operating window of an individual calender has become rather narrow with the increasing drying capacity of the calender. Today the improvement of quality is thus successfully accomplished in practice only by increasing the number of nips in the calender. In connection with this, the controllability problem is aggravated by the fact that with the increasing number of nips, the difficulties in setting the initial moisture content and temperature of the web also increase such as to avoid curl of the web and that the web is still sufficiently moist in the lowermost nips of the calender and thus mouldable, which is of high significance especially with regard to achieving smoothness and also density.

As known in the state of the art, one problem in connection with calenders has been constituted by the high temperatures of thermo rolls because they dry the fibrous web too much.

Calenders known in the state of the art are also modernized so as to meet the requirements of today's technology.

SUMMARY OF THE INVENTION

An aim of the invention is to create a method for optimizing paper quality.

An aim of the invention is to create a new method in calendering of a paper and a board web.

An aim of the invention is also to improve calendering of the web and to improve control of the moisture gradient of the web.

A further aim of the invention is to create a method and a device which are suitable for use in connection with modernization of multinip calendering, in particular in connection with supercalenders.

A further aim of the invention is to create a new method in multinip, soft or long-nip calendering of a paper and board web.

The invention relates to the optimization of moisturizing to maximize the surface quality of paper. When measuring different surface and bulk properties of paper, an optimum moisturizing method has been formed in different quality optimization cases.

In the method for optimizing the quality of paper according to the invention, the web is moisturized, in which connection a liquid, a water emulsion, a liquid mixture or a dispersion is applied at a predetermined location to a paper web or to the surface of the like moving past said location, and the web is passed after that to surface treatment. The liquid is applied at such an early stage that the fibres in the paper web or the like subjected to moisturizing have time to absorb liquid in a sufficient amount of liquid which is required before surface treatment.

The surface treatment contact with the web to be surface-treated and the effect of contact under pressure (e.g. nip effect in a calender) transfer the moisture that has not been absorbed into fibres, fibre walls and/or fibre bonds into them. The moisturizing agent must be in fibres, in fibre walls and/or in fibre bonds, advantageously in fibres.

Advantageously, the moisturizing agent is applied immediately before a nip and/or in a nip and/or during a nip effect and/or between nip effects.

The advantageous applications of the invention, the method in calendering and the calender are based on the use of liquid, water emulsion, liquid mixture, dispersion, water sprays or equivalent moisturizing devices, by means of which the moisture content of the web is raised most preferably such that the moisture content of the web (after the moisturizing device before the set of rolls) when it enters the calender is at a level of 4 to 15%, most preferably 8 to 12%. In the arrangements known in the state of the art, the initial moisture content before the calender has typically been of the order of 2 to 7% (before the set of rolls). In accordance with this embodiment of the invention, moisturizing devices are placed, depending on the calender type and the desired application, very close before the first calendering nip and, about the middle of the nips before a nip in which a thermo roll or equivalent has been placed on one side of the web, for example, close to a reversing nip or before each calendering nip (as shown in FIG. 10) or before desired calendering nips. The location of the moisturizing device is adjusted such that the imbition time after moisturization at a desired running speed before the nip is 0 to 1 s.

In this description, by the imbition time is meant the time during which the moisturization has time to be effective before the effect of calendering in the nip and, in this connection, the imbition time ends when the contact of the surfaces compressed in the calendering nip ends, i.e. the compression pressure ceases to act during the nip effect.

In accordance with the invention, the imbition time of the moisturizing agent is also advantageously controlled, in which connection the middle of the web remains dry and partly recovers after calendering. The web surfaces to be calendered are in turn very plastic because of high moisture content, and deform readily. The middle portion has been brought into a desired moisture content before the moisturization process, which is one of the control parameters of the moisturization gradient used in connection with the invention.

In one advantageous application of the invention in which the method is applied in a multiroll calender in which the set of rolls is formed of an upper set of rolls and of a lower set of rolls, moisturizing devices are placed very close to the first nip and close to a reversing nip. The paper web in the upper set of rolls has a total moisture content of about 4 to 15%, most preferably 5 to 7%, in which connection the permanent compression of the web remains slighter than in arrangements known in the state of the art, in which the moisture content of paper in the upper set of rolls is of the order of 8 to 12%, most preferably 8 to 10%. The first side of the web is calendered in the upper set of rolls and the surface layer is deformed readily while its moisture content is high, typically 20 to 40%. Close to the reversing nip, the other side of the web not yet calendered is subjected to moisturization with water and its surface moisture content is typically 15 to 40% and, after that, the other side of the web is calendered. The suitable final total moisture content of, for example, paper is 4 to 8%.

In accordance with one application of the invention, moisturizing devices are placed asymmetrically such that the distance of the device moisturizing the web side which is calendered second from the first thermo roll nip of the lower set of rolls is equal to the distance of the device moisturizing the web side which is calendered first from the first calendering nip.

The calendering method according to the invention is also applied advantageously such that several moisturizing units are placed inside a set of rolls, which units are, for example, of the type of so-called air-atomizing units or, most advantageously, steam-atomizing units. In connection with the invention, it is advantageous to use steam treatment before or after moisturization. In particular, in connection with air-atomizing units it is advantageous to use steam treatment, for which steam boxes 99, as shown in FIG. 10, are placed most advantageously before a nip after a water moisturizing device, in an apparatus 100.

In accordance with one advantageous further feature of the invention, in addition to moisturizations inside a set of rolls, it is possible to use moisturizers placed outside the set of rolls.

By using moisturization inside the set of rolls in accordance with the invention, considerably higher temperatures can be applied in the calender than those used in the calenders known in the the state of the art. This is advantageous because, for example, when the calendering temperature is raised to a level of 200 to 300° C., a 10-roll calender can be replaced with a 6-roll one. In that connection, it is also often possible to leave out the steam boxes used in state-of-the-art applications, whereby considerable cost savings are achieved. Higher temperatures can be used in connection with the invention for the reason that moisturization allows the moisture content of paper to be regulated, whereas conventional steam moisturization does not function when the temperature of paper rises close to 100° C.

One application of the new and inventive method of multinip calendering and the multinip calender according to the invention is based on the use of moisturizing sprays or equivalent moisturizing devices, by means of which the moisture content of the web is raised in the calender most appropriately such that the moisture content of the web entering the calender is at a level of 1 to 10% and the moisture content of the web coming out of the calender is 4 to 7%. In the arrangements known in the state of the art, the initial moisture content before the calender has been typically of the order of 2 to 4%. In accordance with the invention, moisturizing devices are placed, depending on the type of multinip calender and on the desired application, at least very close before the second calendering nip and after a reversing nip before the calendering nip situated after it. The distance of the moisturizing device is adjusted such that the imbition time after moisturization is 0 to 1 s.

In accordance with an advantageous embodiment of the invention, moisturization inside the calender is used when a multinip calender, most advantageously a supercalender, is modernized, in which connection the already existing 12-roll supercalender can be preserved, and no new deflection-compensated rolls are needed. When modernizing a supercalender, water moisturizing devices are placed very close before the second nip and after the reversing nip before the nip situated after it. The drying and possible overdrying of the web are compensated for by this means. The surface temperature of the thermo roll placed after the liquid moisturizing device as well as that of the roll situated after it can be 100 to 350° C., advantageously 150 to 250° C. The thermo rolls after the reversing nip can also be kept at a temperature of 100 to 350° C., advantageously 150 to 250° C. In this way, in the modernization arrangement according to the invention it is possible to use very high temperatures of thermo rolls because the drying of the web in calendering is compensated for by inside moisturizing. When using the arrangement according to the invention, the loading principle of the 12-roll supercalender can be kept unchanged, thereby achieving savings of costs. A supercalender according to an advantageous application of the invention comprises at least two, most advantageously four hot thermo rolls and at least two liquid moisturizing devices as well as four, most preferably six polymer covered rolls.

In accordance with one advantageous further feature of the invention, moisturization/steam treatment is/are used for profiling in the cross direction. By means of the profiling it is possible to affect the properties of the web in the cross direction.

The invention is suitable for use both in on-line and in off-line calendering. Above, the invention has mainly been described in connection with on-line calendering. In off-line calendering, the basic principles of the method and the calender according to the invention correspond to those described above, but 4 to 6% is most advantageously used as the ingoing moisture content of paper before moisturization, and moisturization can be accomplished either one-sidedly or two-sidedly.

The invention is particularly suitable for use in connection with multiroll calenders but also in connection with other types of calenders, among other things, soft or extended-nip calenders. Depending on the calender application, the moisturizer is placed, for example, before each nip or before desired nips or before the first nip and close to or in a reversing nip.

The invention is particularly suitable for use in connection with multinip calenders, in particular supercalenders.

BRIEF DESCRIPTION OF THE DRAWINGS

In the following, the invention will be described in more detail with reference to the FIGS. 1 to 9 in the accompanying drawing, to the details of which the invention is, however, not by any means intended to be narrowly confined.

The invention and the general benefits attainable by the invention, when the surface properties of paper have been optimized in accordance with the invention, have been illustrated by means of the accompanying FIGS. 1 to 7, in which

FIGS. 5A and 5B show how the invention provides an improvement over different types of known calenders and calendering methods.

The table of FIG. 6 shows typical times of absorption of liquid into fibres.

FIGS. 7A and 7B show measured moisture gradients of paper. Small water amounts with short contact times form a moisture gradient.

Figure 1:
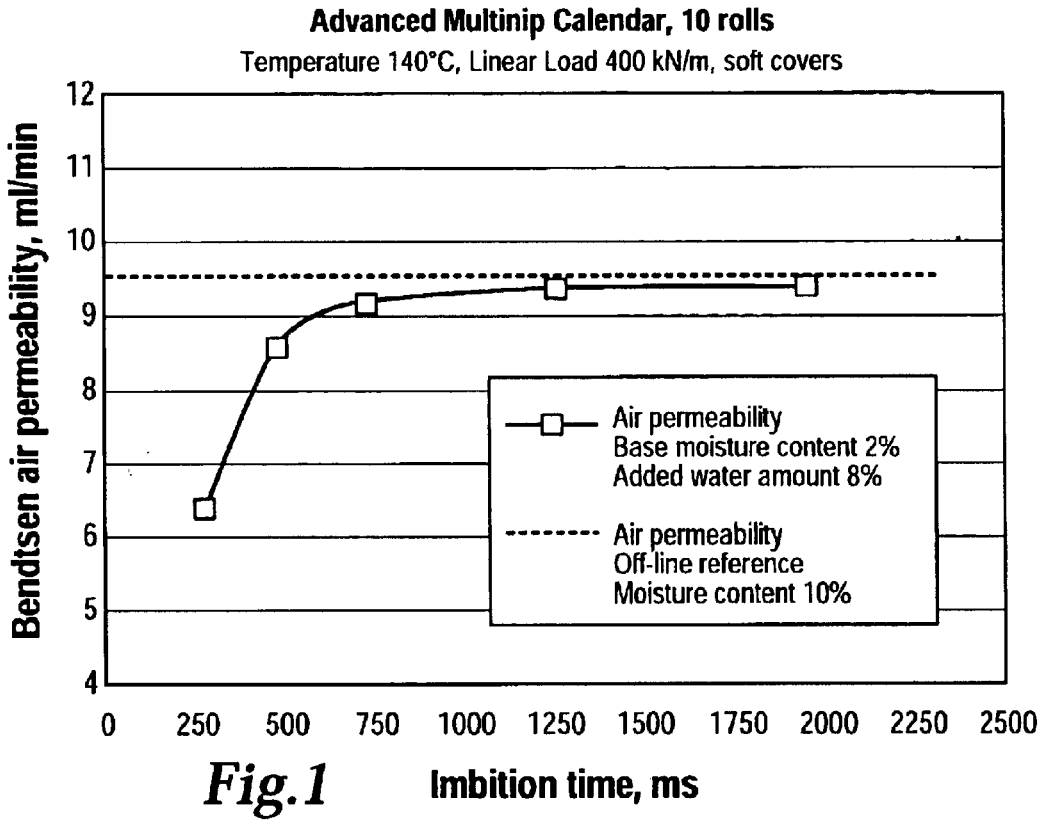
FIG. 1 illustrates the significance of moisturizing time for paper permeability in a multinip calender comprising 10 rolls. The calendering temperature is 140° C. and the linear load is 400 kN/m.
Figure 2:
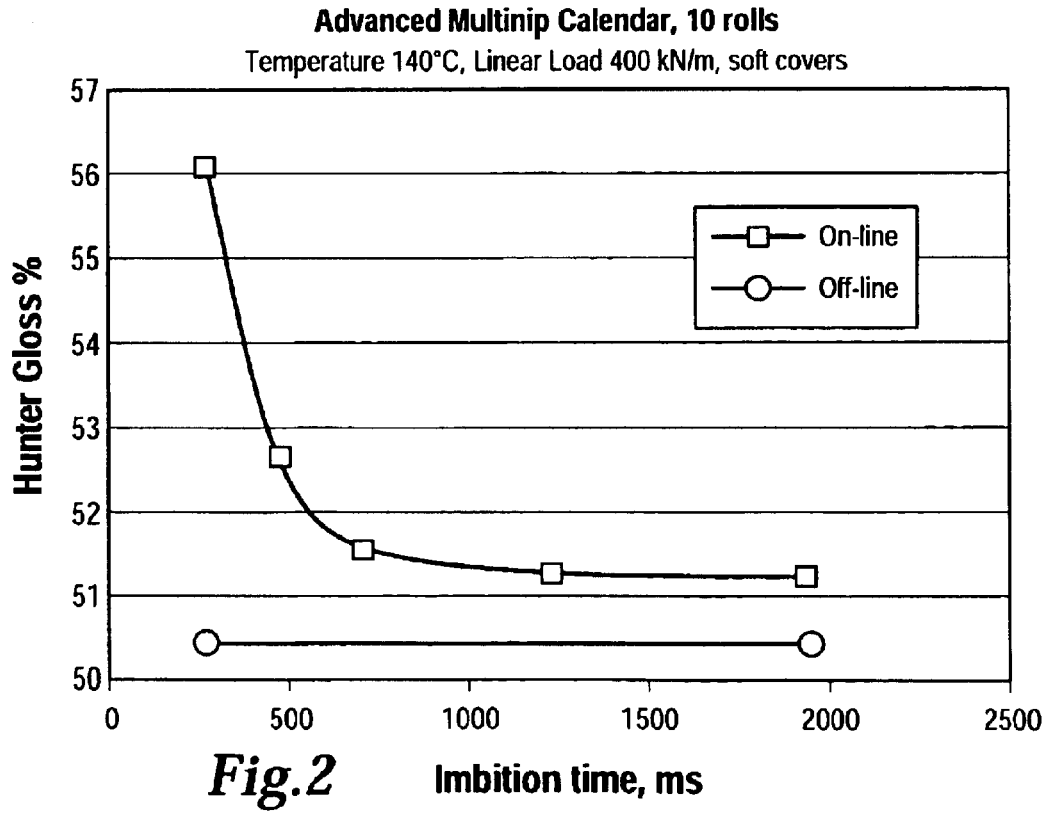
FIG. 2 illustrates the significance of moisturizing time for the gloss of paper. The calender and the calendering conditions are the same as those described in connection with FIG. 1.
Figure 3A:
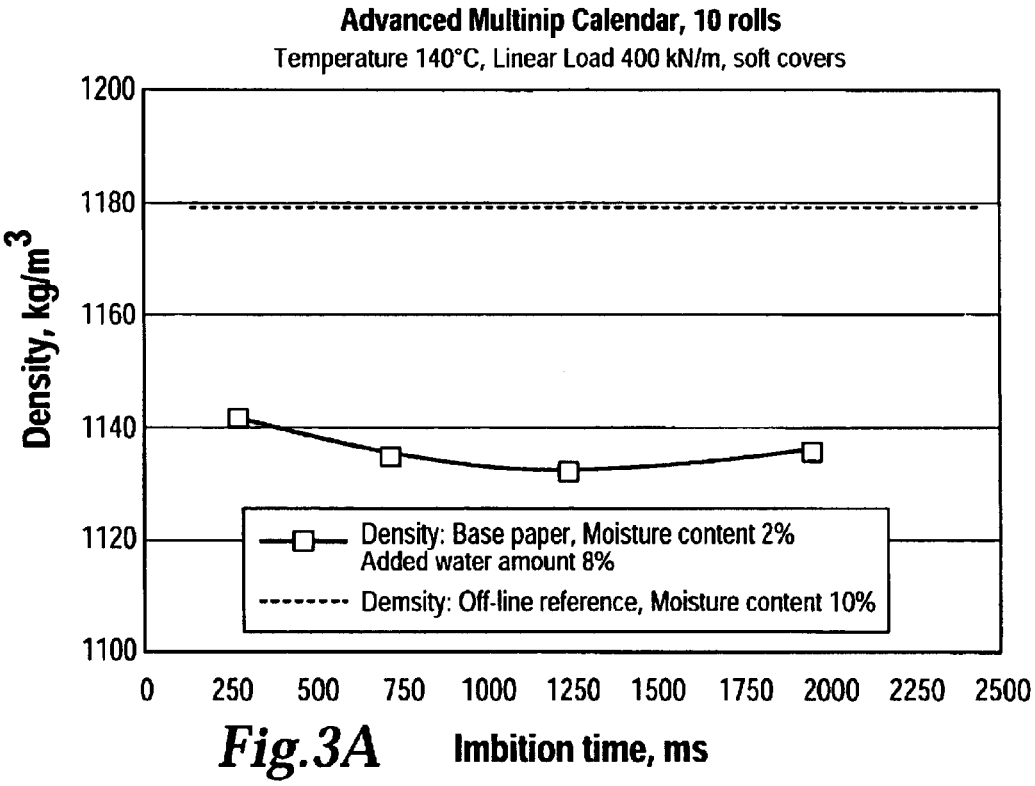
FIGS. 3A and 3B illustrate the significance of moisturizing time for paper density such that FIG. 3A shows a correlation between moisturizing time and density and FIG. 3B shows three different cases (case #1, case #2 and case #3) of the relationship of density to air permeability. The calender and the conditions are the same as in FIGS. 1 and 2.
Figure 3B:
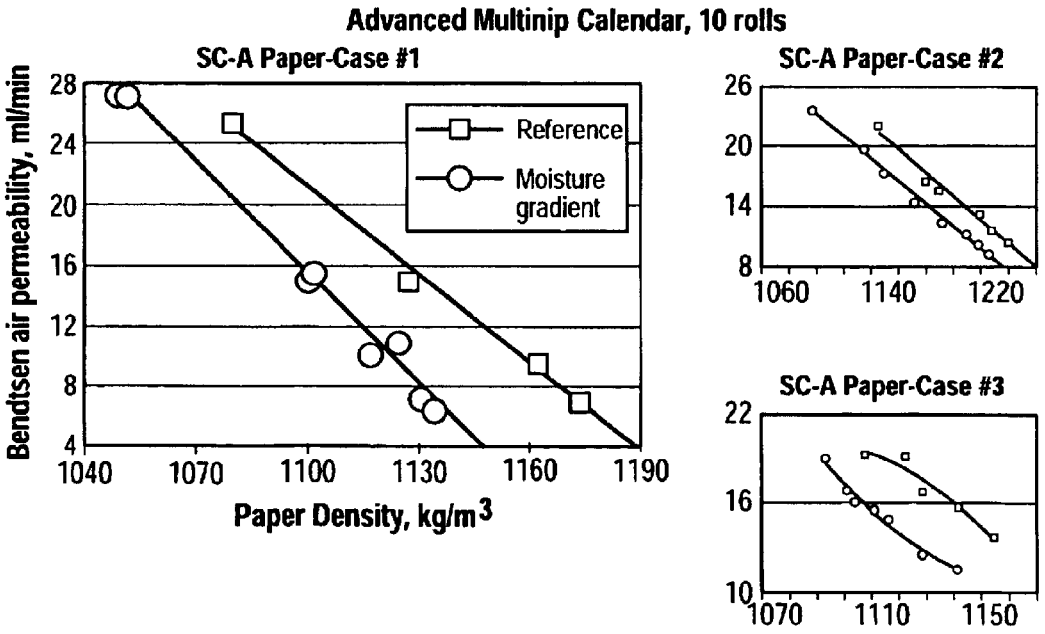
Figure 4:
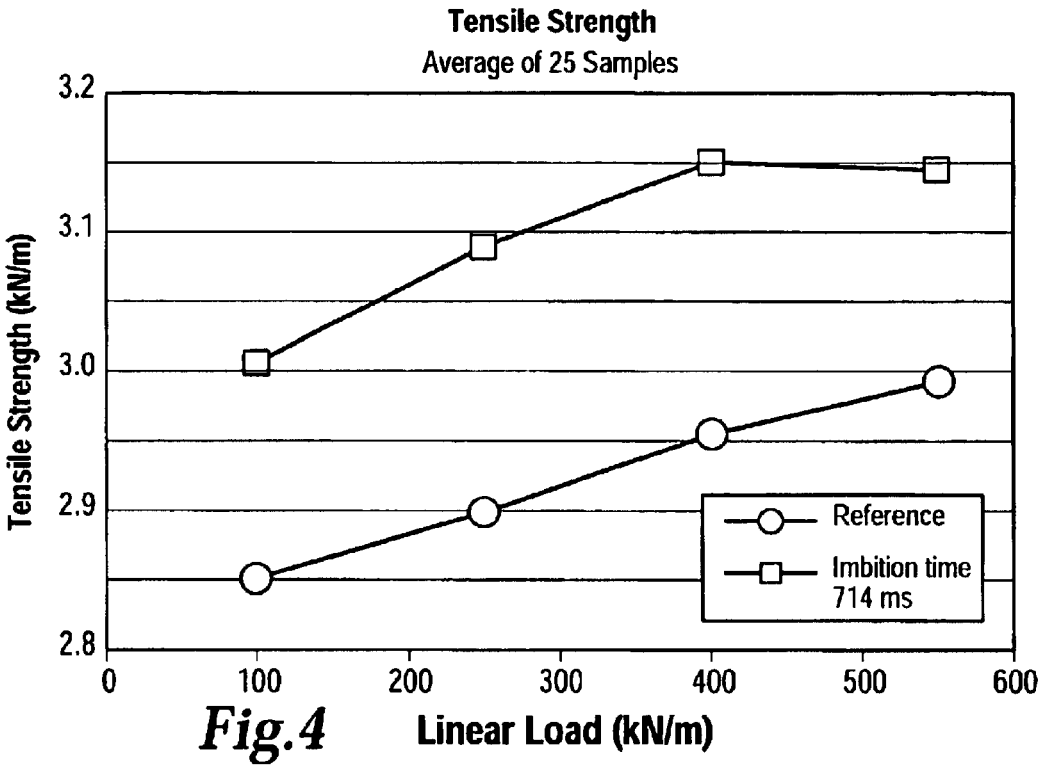
FIG. 4 illustrates how the strength properties are formed and preserved better when using the method according to the invention. The figure shows the relationship between tensile strength and linear load. The linear load is the average of 25 samples.
Figure 5A:
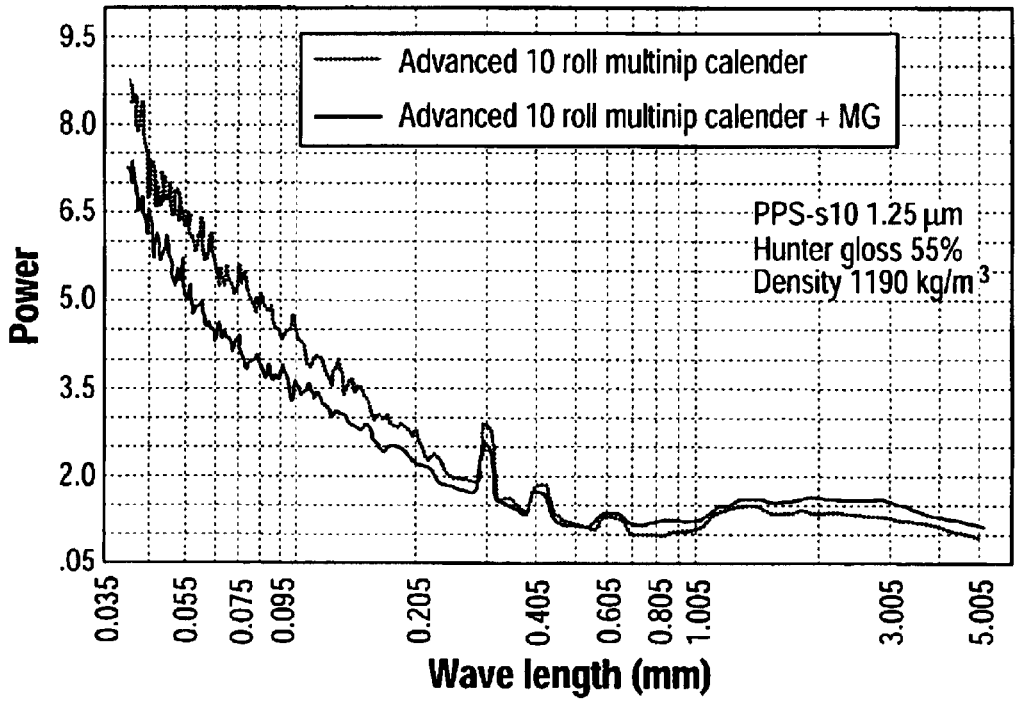
FIGS. 5A and 5B show how paper is smoother on a small scale, which leads to better printability and, for example, to lower consumption of printing ink.
Figure 5B:
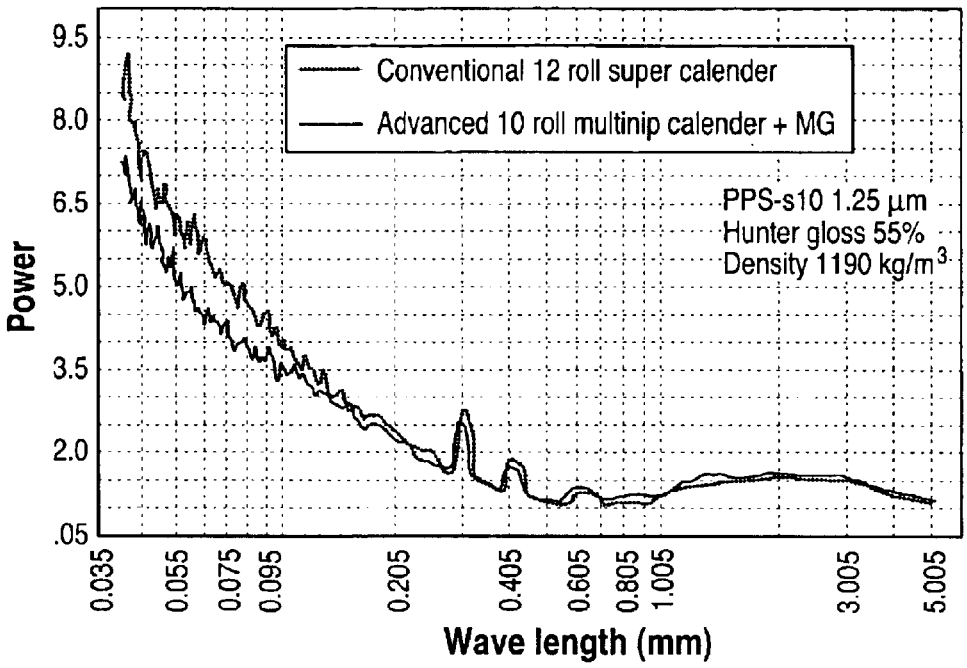
Figure 5C:
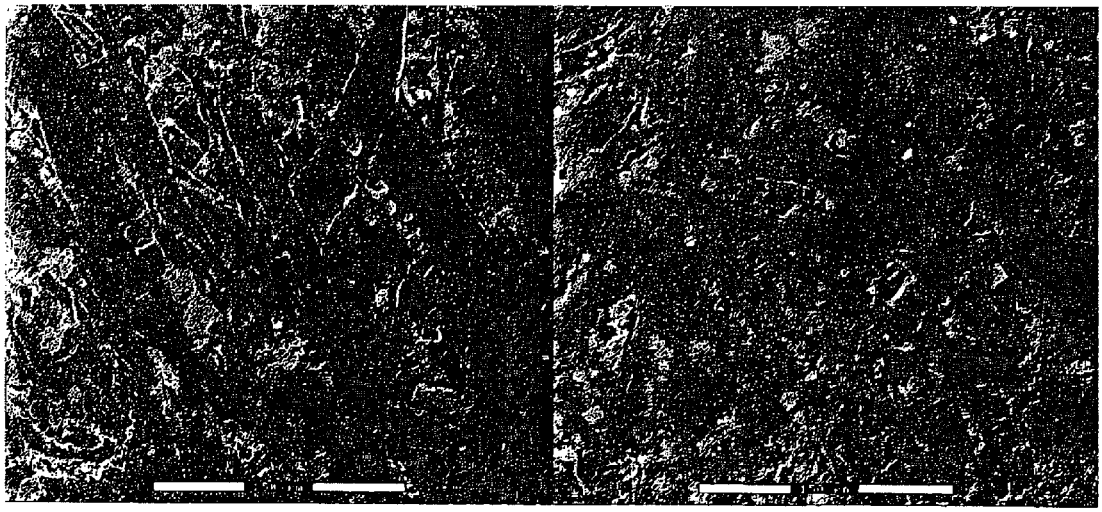
FIG. 5C shows how small-scale smoothness in the method according to the invention is better than previously. The surface of the paper is molten, i.e. smooth, that is, when using the invention, the paper is visually smoother.
Figure 8:
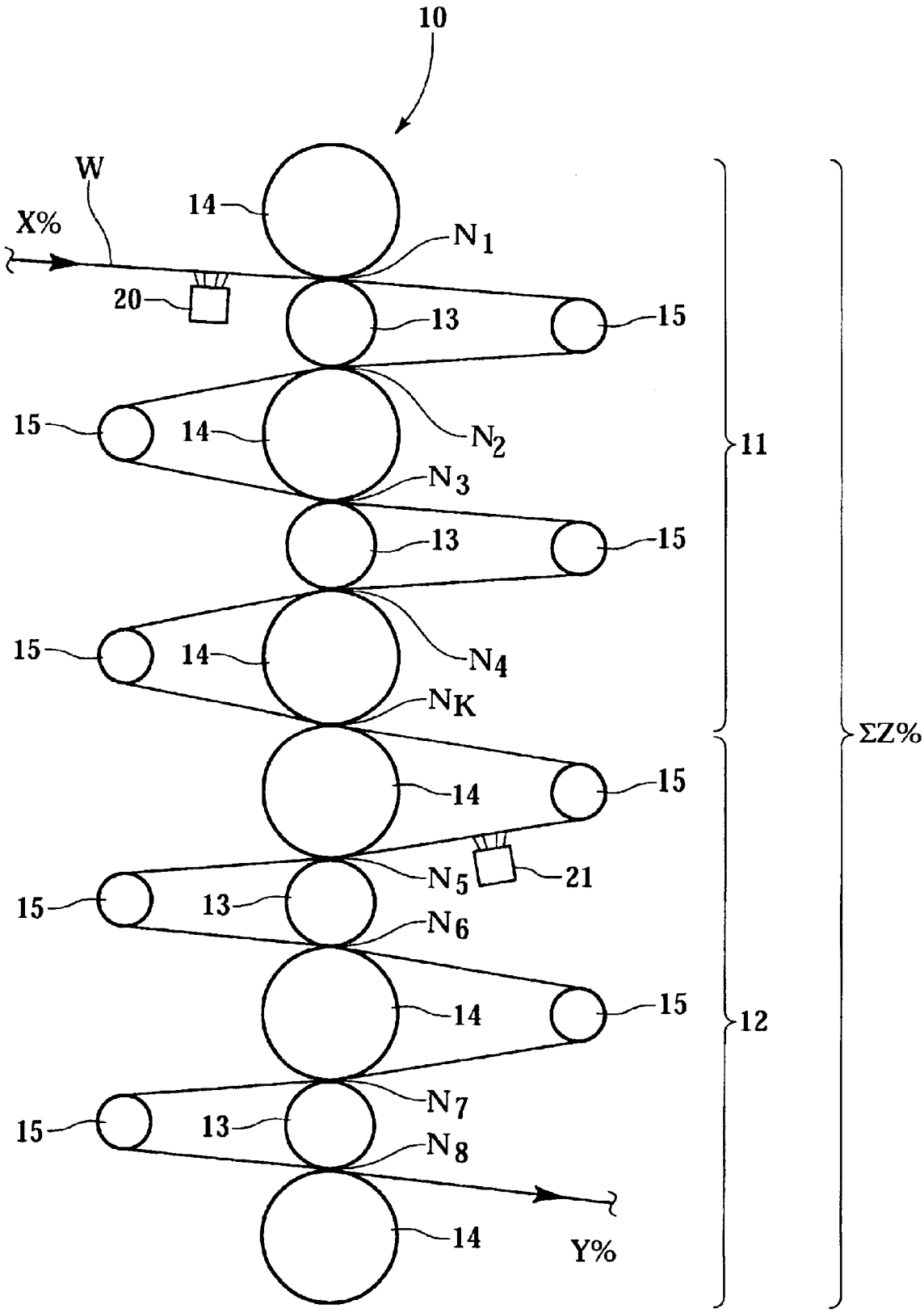

FIG. 8 schematically shows an application of the invention in connection with a multiroll calender.

Figure 9:
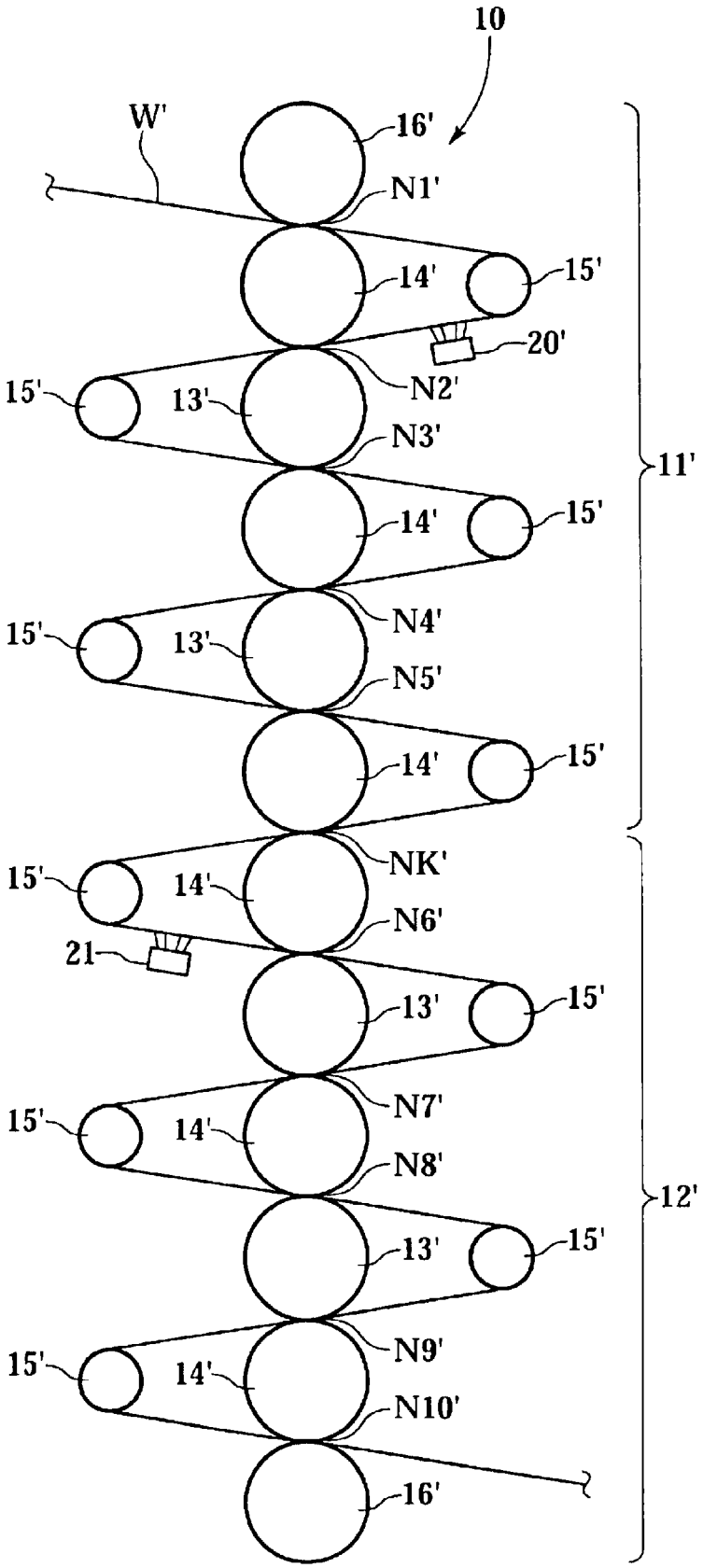

FIG. 9 schematically shows an application of the invention in connection with a supercalender.

Figure 10:
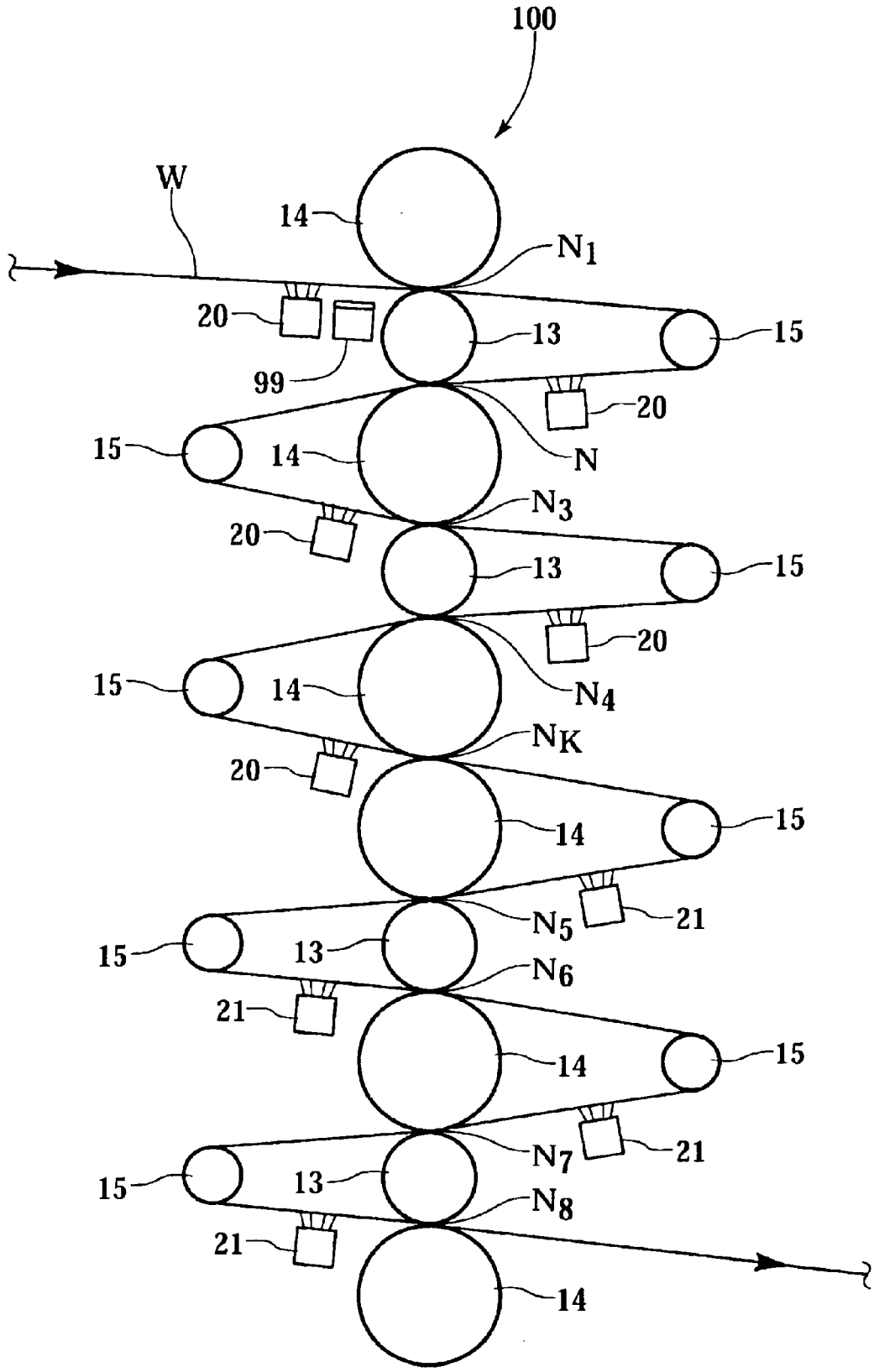

FIG. 10 schematically shows an application of the invention in connection with a multiroll calender having a liquid moisturizing device placed before each nip of the calender, and a separate steam box placed before a nip after a liquid moisturizing device.

DESCRIPTION OF THE PREFERRED EMBODIMENTS

In accordance with FIG. 8, the multiroll calender is composed of a set of rolls 10 in which several calendering nips N1, N2–N8 have been formed one upon the other, wherein the set of rolls 10 of the multiroll calender is formed of an upper set of rolls 11 and of a lower set of rolls 12, which are formed of smooth-surface press rolls 13, such as metal rolls, of rolls 14 coated with a resilient cover, such as paper or polymer rolls, placed alternately one over the other, and of reversing or guide members 15 guiding the run of the web W to be calendered. The successive nips N1, N2–N8 of the multiroll calender are thus always formed between a rigid-shell roll 13 and a resilient-shell roll 14. Between the upper set of rolls 11 and the lower set of rolls 12 there is a reversing nip NK, in connection with which the side of the web W to be calendered is changed. In accordance with an advantageous application of the invention, a moisturizing device 20, 21 is placed before the first calendering nip and close to the reversing nip NK. The top and bottom rolls in the set of rolls 10 are deflection-compensated polymer rolls.

The run of the fibrous web W which is calendered is as follows. The web W is run via the moisturization 20 into the topmost first nip N1 of the upper set of rolls 11 in the multiroll calender, from which nip the web W is run around a turning member 15, for example a turning roll into the next lower nip N2. After that, the web W meanders around turning members 15 and runs through the next nip N3 and, after that, the web W is run through the lowermost nip N4 of the upper set of rolls 11. After that, the web W side to be calendered is changed in the reversing nip NK, and the web W is passed via the moisturizing device 21 placed close to the reversing nip NK into the first nip N5 of the lower set of rolls 12, from which nip the web W is run again around a turning member 15 into the next lower nip N6. The invention also encompasses applications in which the web is run through the so-called reversing nip while the nip is open, in which connection the web is not compressed in the nip. Again, the web W meanders around turning members 15 and runs through the next nip N7 and finally the web W is run through the lowermost nip N8 of the lower set of rolls 12. After the bottom nip N8 of the lower set of rolls 12, the web W is run to the process stage which follows after calendering.

Thus, in the application of the invention shown in this FIG. 8, the web W side to be calendered first is moisturized with the moisturizing device 20 before the first nip N1 and the other side of the web W is moisturized close to the reversing nip NK with the moisturizing device 21. The location of the moisturizing device 20 with respect to the first nip N1 is adjusted such that the imbition time after moisturization is 0 to 1 s, most preferably 100 to 400 ms, and the distance of the moisturizing device 21 from the reversing nip NK is adjusted such that the imbition time after moisturization is 0 to 1 s, most preferably 100 to 400 ms.

As shown in FIG. 9, the supercalender is composed of a set of rolls 10' in which several calendering nips N1', N2'–N8' have been formed one upon the other, wherein the set of rolls 10' of the multiroll calender is formed of an upper set of rolls 11' and of a lower set of rolls 12', which are formed of heatable, smooth-surface press rolls, i.e. thermo rolls 13', such as metal rolls, of rolls 14' coated with a resilient cover, such as paper or polymer rolls, placed alternately one other the other, and of reversing or guide members 15' guiding the run of the web W' to be calendered, as well as of deflection-compensated rolls 16' of the set of rolls 10', which rolls 16' are situated as the top and bottom rolls of the set of rolls 10'. The successive nips N2'–N9' of the multiroll calender are thus formed between a thermo roll 13' and a resilient-surface roll 14'. Between the upper set of rolls 11' and the lower set of rolls 12' there is a reversing nip NK' formed between two resilient-surface rolls 14', in connection with which nip the side of the web W' to be calendered is changed. In accordance with this application of the invention, a water moisturizing device 20', 21' is placed very close before the second calendering nip N2' and after the reversing nip NK', before the first nip N6' of the lower set of rolls 12'.

The run of the fibrous web W' which is calendered is as follows. The web W' is run into the topmost first nip N1' of the upper set of rolls 11' of the calender, in which nip the temperature of the deflection-compensated roll 16' is about 60° C., from which nip N1' the web W' is run around a turning member 15', for example a turning roll via the moisturization 20' into the next lower, i.e. second nip N2'. After that, the web W' meanders around turning members 15' and runs through the next nips N3', N4' and, after that, the web W' is run through the lowermost nip N5' of the upper set of rolls 11'. The temperature of the thermo rolls 13' in the upper set of rolls 11' is 100 to 350° C., advantageously 150 to 250° C. and that of the deflection-compensated roll 16' about 60° C. After that, the web W' side to be calendered is changed in the reversing nip NK', and the web W' is passed after the reversing nip NK' via the moisturizing device 21' placed before the first nip N6' of the lower set of rolls 12' into the first nip N6' of the lower set of rolls 12', from which nip the web W' is run again around a turning member 15' into the next lower nip N7'. Again, the web W' meanders around turning members 15' and runs through the next nips N8', N9' and finally the web W' is run through the lowermost nip N10' of the lower set of rolls 12'. The temperature of the thermo rolls 13' in the lower set of rolls 12' is 100 to 350° C., advantageously 150 to 250° C. and the temperature of the deflection-compensated steel roll 16' is about 60° C. After the bottom nip N8' of the lower set of rolls 12', the web W' is run to the process stage which follows after calendering.

Thus, in the application of the invention shown in this FIG. 9, the web W' side to be calendered first is moisturized with the moisturizing device 20' before the second nip N2' and the other side of the web W' is moisturized after the reversing nip NK' with the moisturizing device 2140 . The distance of the moisturizing device 20' from the nip N2' is adjusted such that the imbition time after moisturization is 0 to 1 s, most preferably 100 to 400 ms, and the distance of the moisturizing device 21' from the nip N6' is adjusted such that the imbition time after moisturization is 0 to 1 s, most preferably 100 to 400 ms.

In determining the location of the moisturizing device, the point of the nip is considered to be that point in the nip in which the contact of compressing surfaces ends, i.e. the compression pressure ceases to act during the nip effect.

The amount of moisturization used in connection with the invention $$\Sigma Z = Z_{top\ surface} + Z_{bottom\ surface},$$

where $Z_{top\ surface}$ and $Z_{bottom\ surface}$ are surface moisturization values. The moisturization amount is divided for the upper set of rolls and for the lower set of rolls based on desired smoothness, gloss, curl and porosity and, when needed, regulation of unequal sidedness $Z_{top\ surface}/Z_{bottom\ surface}$ (advantageously 0.8 to 1.2) is carried out.

A typical final moisturization target

Y %=(X %+ΣZ %)−amount of evaporation (typically 3.5 to 6.5%) amount of evaporation=f (T, roll diameter, roll material, load, speed, web run) (typically 1 to 6%)

X %=moisture content of paper when it enters the calender.

The reference signs indicating the computational process are shown in FIG. 8.

Above, the invention has been described with reference to one of its advantageous embodiments only, to the details of which the invention is not by any means intended to be narrowly confined.

What is claimed is:

1. A method for calendering a paper or board web in a multinip calendar, having at least two hot thermo rolls between 100 and 350 degrees C. and at least four polymer covered rolls in the multinip calender, the calender being arranged to form an upper set of rolls having at least a first polymer covered roll followed by a first hot thermo roll, followed by a second polymer covered roll; and a lower set of rolls having a third polymer covered roll followed by a second hot thermo roll, followed by a fourth polymer covered roll;

wherein calendering nips are formed between the first polymer covered roll and the first hot thermo roll, between the first hot thermo roll and the second polymer covered roll, and between the third polymer covered roll and the second hot thermo roll, and between the second hot thermo roll and the fourth polymer covered roll;

wherein a web is calendered in said calendering nips; and wherein the web is moisturized a first time, on a first side of the web before passing through at least one nip in the upper set of rolls by a first liquid moisturizing device producing a drop size of less than 20 μm on average so that the moisture content of the web is raised to a moisture content of between 8 and 12 percent, the time between when the web is moisturized the first time and the web passes through said at least one nip in the upper set of rolls is such that the moisture is concentrated in a first surface layer so that the first surface layer has a moisture content of 20 percent to 40 percent while passing through said at least one nip in the upper set of rolls; and wherein the web is moisturized a second time, on a second side of the web before passing through at least one nip in the lower set of rolls by a second liquid moisturizing device producing a drop size of less than 20 μm on average, the time between when the web is moisturized the second time and the web passes through said at least one nip in the lower set of rolls is such that the moisture is concentrated in a second surface layer so that the second surface layer has a moisture content of 15 percent to 40 percent while passing through said at least one nip in the lower set of rolls.

2. The method of claim 1 wherein the moisture content of the web is raised to a moisture content of between 8 and 10 percent by the first liquid moisturizing device.

3. The method of claim 1 wherein the moisture content of the web coming out of the calender is brought by means of the second liquid moisturizing device to a target moisture level of 4 percent to 8 percent.

4. The method of claim 1, wherein the web is moisturized before a first calendering nip of the calender.

5. The method of claim 1 wherein the web is moisturized before each calendering nip.

6. The method of claim 1, wherein the web is moisturized by means of liquid moisturization very close before between the nip formed by the first hot thermo roll and the second polymer roll of the upper set of rolls and the web is moisturized by means of liquid moisturization very close after a reversing nip defined between the second polymer roll and the third polymer roll before the nip between the third polymer roll and the second hot thermo roll.

7. The method of claim 1 wherein the web is moisturized before more than two calendering nips.

8. The method of claim 1, wherein the two hot thermo rolls of the calender are heated to a temperature of 150 to 250° C.

9. A multinip calender for calendering a paper or board web, comprising:

an upper set of rolls comprising at least a first polymer covered roll, followed by a first hot thermo roll, followed by a second polymer covered roll;

a lower set of rolls comprising at least a third polymer covered roll followed by a second hot thermo roll, followed by a fourth polymer covered roll, wherein each of the hot thermo rolls is between 100 and 350 degrees C.;

a first calendering nip defined between the first polymer covered roll and the first hot thermo roll, a second calendering nip defined between the first hot thermo roll and the second polymer covered roll, a third calendering nip defined between the third polymer covered roll and the second hot thermo roll, a fourth calendering nip defined between the second hot thermo roll and the fourth polymer covered roll, wherein the paper or board web extends through the first calendering nip, the second calendering nip, the third calendering nip, and the fourth calendering nip;

a first liquid moisturizing device which produces a drop size of less than 20 $\mu$m on average, and positioned to moisturize the web a first time on a first side of the web before the web passes through at least one nip in the upper set of rolls, the first liquid moisturizing device being disposed to moisturize the web such that the moisture content of the web is raised to a moisture content of between 8 and 12 percent, the first moisturizing device being positioned with respect to said at least one nip such that the time between when the web is moisturized the first time and the web passes through said at least one nip in the upper set of rolls is such that the moisture is concentrated in a first surface layer so that the first surface layer has a moisture content of 20 percent to 40 percent while passing through said at least one nip in the upper set of rolls; and a second liquid moisturizing device producing a drop size of less than 20 $\mu$m on average, and positioned to moisturize the web a second time, on a second side of the web before the web passes through at least one nip in the lower set of rolls, the second liquid moisturizing device being positioned such that the time between when the web is moisturized the second time and the web passes through said at least one nip in the lower set of rolls is such that the moisture is concentrated in a second surface layer so that the second surface layer has a moisture content of 15 percent to 40 percent while passing through said at least one nip in the lower set of rolls.

10. The multinip calender of claim 9 wherein a reversing nip is defined between the second polymer covered roll and the third polymer covered roll and wherein the first liquid moisturizing device is placed before a first nip of the upper set of rolls, and the second liquid moisturizing device is placed close to the reversing nip before the nip formed between the third polymer roll and the second hot thermo roll.

11. The multinip calender of claim 9 wherein a liquid moisturizing device is placed before each nip of the calender.

12. The multinip calender of claim 9 wherein each liquid moisturizing device is an air-atomizing device.

13. The multinip calender of claim 9 wherein each liquid moisturizing device is a steam-atomizing device.

14. The multinip calender of claim 9 wherein a separate steam box is placed in connection with one of the first and second liquid moisturizing devices.

15. The multinip calender of claim 9 wherein the liquid moisturizing devices are placed asymmetrically such that the distances of the devices from the nips situated after them are equal.

16. The multinip calender of claim 9 wherein at least one of the first liquid moisturizing device and the second liquid moisturizing device allows profiling in the cross direction.

* * * * *

UNITED STATES PATENT AND TRADEMARK OFFICE

CERTIFICATE OF CORRECTION

PATENT NO. : 6,758,135 B2
DATED : July 6, 2004
INVENTOR(S) : Pekka Linnonmaa et al.

It is certified that error appears in the above-identified patent and that said Letters Patent is hereby corrected as shown below:

Column 9,
Line 15, "2140" should be -- 21' --.

Signed and Sealed this

Thirty-first Day of August, 2004

JON W. DUDAS
*Director of the United States Patent and Trademark Office*